US012035744B2

(12) United States Patent
Cieslikowski

(10) Patent No.: US 12,035,744 B2
(45) Date of Patent: Jul. 16, 2024

(54) REPLENISHING DEVICE, AN APPARATUS FOR MANUFACTURING MULTI-SEGMENT RODS AND A METHOD FOR MANUFACTURING MULTI-SEGMENT RODS

(71) Applicant: International Tobacco Machinery Poland Sp. z o.o., Radom (PL)

(72) Inventor: Bartosz Cieslikowski, Przysucha (PL)

(73) Assignee: International Tobacco Machinery Poland Sp. z o.o., Radom (PL)

( * ) Notice: Subject to any disclaimer, the term of this patent is extended or adjusted under 35 U.S.C. 154(b) by 0 days.

(21) Appl. No.: 16/766,693

(22) PCT Filed: Nov. 21, 2018

(86) PCT No.: PCT/EP2018/081999
§ 371 (c)(1),
(2) Date: May 24, 2020

(87) PCT Pub. No.: WO2019/105813
PCT Pub. Date: Jun. 6, 2019

(65) Prior Publication Data

US 2021/0368858 A1 Dec. 2, 2021

(30) Foreign Application Priority Data

Dec. 3, 2017 (PL) ..... P.423675

(51) Int. Cl.
*A24C 5/32* (2006.01)
*A24C 5/10* (2006.01)
(Continued)

(52) U.S. Cl.
CPC ..... *A24C 5/325* (2013.01); *A24C 5/10* (2013.01); *A24C 5/28* (2013.01); *A24C 5/327* (2013.01); *A24C 5/35* (2013.01)

(58) Field of Classification Search
CPC ..... B65B 19/04; A24C 5/31; A24C 5/325; A24C 5/35; A24C 5/327; A24C 5/326
See application file for complete search history.

(56) References Cited

U.S. PATENT DOCUMENTS

| | | | | |
|---|---|---|---|---|
| 1,680,024 A | | 8/1928 | Ewald | |
| 3,731,451 A | * | 5/1973 | Sexstone | A24D 3/02 53/53 |
| 2004/0129531 A1 | * | 7/2004 | Nagai | A24C 5/345 198/370.12 |

FOREIGN PATENT DOCUMENTS

| | | |
|---|---|---|
| DE | 497881 | 5/1930 |
| DE | 102005034245 | 2/2007 |
| EP | 0208925 | 1/1987 |

OTHER PUBLICATIONS

Lumen Learning. "Vector Nature of Rotational Kinematics." Lumen, https://courses.lumenlearning.com/boundless-physics/chapter/vector-nature-of-rotational-kinematics/. (Year: 2021).*

(Continued)

*Primary Examiner* — Michael H. Wilson
*Assistant Examiner* — Stephanie Lynn Moore
(74) *Attorney, Agent, or Firm* — Soody Tronson; STLG Law Firm

(57) ABSTRACT

A replenishing device for replenishing a flute of a transporter with a rod-like element, wherein the transporter comprises multiple flutes located transversally with respect to a transporting direction and adapted to transport rod-like elements, the replenishing device comprising: a feeding duct for feeding the rod-like element; a rotary replenishing element having an axis of rotation, comprising at least one transferring seat for receiving the rod-like element from the feeding duct in a receiving zone and for transferring the rod-like element to the flute of the transporter in a transferring zone, wherein the rotary replenishing element is adapted to repeat- (Continued)

edly pass the same rod-like element through the transferring zone before transferring that rod-like element to the flute of the transporter; and a transferring mechanism for effecting the transfer of the rod-like element from the transferring seat to the flute of the transporter.

20 Claims, 9 Drawing Sheets

(51) Int. Cl.
*A24C 5/28* (2006.01)
*A24C 5/35* (2006.01)

(56) References Cited

OTHER PUBLICATIONS

"Science of Everyday Things" Encyclopedia.Com. Date accessed: May 23, 2023 . Date published/updated: May 23, 2018, www.encyclopedia.com/science-and-technology/physics/physics/centripetal-force-and-centrifugal-force. (Year: 2018).*
PCT Search Report and Written Opinion re PCT/EP2018/081999.

* cited by examiner

REPLENISHING DEVICE, AN APPARATUS FOR MANUFACTURING MULTI-SEGMENT RODS AND A METHOD FOR MANUFACTURING MULTI-SEGMENT RODS

TECHNICAL FIELD

The present disclosure relates to a replenishing device, a machine for manufacturing multi-segment rods and a method for manufacturing multi-segment rods.

BACKGROUND

In tobacco industry final products, such as cigarettes, cigarillos and semi-finished products in a form of tobacco rods, filter rods—from a single type of filter material or multi-segment from different filter materials, as well as their component elements (segments) may be defined by a common term: rod-like elements. During a manufacturing process the rod-like elements are often placed in reservoirs, from where they are fed in a mass flow, i.e. through ducts encompassing multiple layers of rod-like elements or through a single layer ducts, to further stages of the manufacturing process, depending on a construction and a demand of a fed unit. The rod-like elements may be displaced under the force of gravity, and also by means of transporters. Drum transporters having flutes on their peripheral surface, are often used in the machines for manufacturing multi-segment filter rods. The rod-like elements may be fed from a reservoir directly to the flutes of such transporter, wherein the drum transporter is located under the reservoir. The multi-segment rod-like element comprises segments of different materials. The machine for manufacturing multi-segment rods is usually equipped with several modules for feeding with segments of one type of material, wherein each of the modules is equipped with the filter rods reservoir and the drum transporter. The filter rods are cut on the drum transporter into multiple segments, and the segments from individual modules are fed onto the common track on which the rods are manufactured. For manufacturing proper multi-segment rods it is necessary to maintain continuous feeding of the filter rods on the drum transporters in the individual modules. For a low rotational velocity of the drum transporter it is possible to obtain a 100% filling of the flutes with filter rods, whereas for higher velocities, single flutes may remain not filled. In a case when the flute is not filled, i.e. when one filter rod is missing, multiple defective, incomplete multi-segment rods are manufactured, because the segments from a single filter rod are located in multiple multi-segment rods. It is possible to automatically reject all defective rods from the production or in case of the machine stoppage it is possible to manually reject the defective rods. In both cases the productivity of the machine is decreased, wherein during the stoppage and restarting of the machine, it happens that the proper quality rods are also rejected, which results in that the scrap rate is significantly higher. Currently, for manufacturing multi-segment filter rods, rods comprising tobacco or a material with processed tobacco, are also used. Moreover, segments which are used for example to cool down cigarette smoke, or have decorative function are also placed in the rods.

A device for replenishing flutes of a drum transporter with rod-like elements is known from the European patent EP208925B1. The replenishing mechanism for feeding elements into empty flutes is operating in a step by step manner after detecting the empty flute and performing an angular movement equal to an angle of seats distribution in this mechanism. There also exists a patent DE4342829, which discloses a mechanism which collects a single cigarette from a feeding duct and transfers it to an empty flute, wherein in order to collect the cigarette and to transfer it to the flute, the collector hits the motionless cigarette. In this solution the cigarette is subjected to high loads and therefore it may be damaged during the transportation. None of the solutions is suitable for high velocities of the manufacturing machine. On the manufacturing machines are also employed belt conveyors or chain conveyors provided with flutes which also need to be filled during operation.

Currently, faster and faster production machines are used and each rejection of defective products during their operation and each stoppage of the machine decreases the productivity of the manufacturing machine. The manufacturers aim at having manufacturing machines of highest possible productivity also at high velocities. Continuous feeding of semi-products has the highest influence on maintaining high productivity. In case of the machines manufacturing multi-segment rods, lack of a single filter rod may cause a rejection of multiple multi-segment rods. Therefore such machines should be equipped with replenishing devices, for replenishing the flutes on the transporters, transferring single elements, wherein the replenishing may be carried out with rod-like elements or replacement rod-like elements. Utilizing the replacement rod-like elements provides continuity of the production, while rejecting a group of the multi-segment rods comprising segments made from replacement rod-like elements causes significantly lower losses than the stoppage of the machine.

SUMMARY

There is disclosed a replenishing device for replenishing a flute of a transporter with a rod-like element, wherein the transporter comprises multiple flutes located transversally with respect to a transporting direction and adapted to transport rod-like elements, the replenishing device comprising: a feeding duct for feeding the rod-like element; a rotary replenishing element having an axis of rotation, comprising at least one transferring seat for receiving the rod-like element from the feeding duct in a receiving zone and for transferring the rod-like element to the flute of the transporter in a transferring zone, wherein the rotary replenishing element is adapted to repeatedly pass the same rod-like element through the transferring zone before transferring that rod-like element to the flute of the transporter and a transferring mechanism for effecting the transfer of the rod-like element from the transferring seat to the flute of the transporter.

The rotary replenishing element may comprise at least two seats.

The transferring mechanism may comprise movable pushing-off elements.

The transferring mechanism may comprise a pivotal lever, on which an axis of rotation of the rotary replenishing element is mounted.

The transferring device may comprise a negative pressure supply unit and a compressed air supply unit.

The seat may have an axis of rotation that circulates around the axis of rotation of the rotary replenishing element.

The rotary replenishing element may have the seat connected to a first gear wheel that is coupled with a second gear wheel, wherein the axis of the first gear wheel rotates with a first rotational velocity, and the second gear wheel rotates with a second rotational velocity, and a rotational velocity of the seat depends on a difference between the first rotational velocity and the second rotational velocity.

The transferring mechanism may have the seat mounted on an arm and connected to the first gear wheel coupled with the second gear wheel.

The transporter may be a drum transporter.

The transporter may be a belt transporter.

A velocity imparted to the rod-like element by the transferring seat in the transferring zone may be equal to a velocity of the flute.

There is also disclosed an apparatus for manufacturing multi-segment rods, the apparatus comprising a feeding unit, a garniture unit and a transferring device located between the feeding unit and the garniture unit, wherein the feeding unit comprises feeding modules, and the garniture unit comprises a garniture device and a cutting head. The feeding module comprises a replenishing device as described herein.

There is also disclosed a method for manufacturing multi-segment rods, the method comprising the steps of: supplying at least two types of rod-like elements to separate feeding modules of a manufacturing machine; placing the rod-like elements in a reservoir of the feeding module of the manufacturing machine; placing the rod-like elements, accumulated in the reservoir, into flutes of a transporter in a transporting path of the feeding module; cutting the rod-like elements into segments while the rod-like elements are transported on the transporter; forming a train of segments comprising segments supplied by the transporting paths from individual reservoirs of the feeding modules; wrapping the formed train of segments by a wrapper to form a continuous rod; and cutting the formed continuous rod into individual multi-segment rods. The method further comprises the steps of: delivering a rod-like element to a rotary replenishing element of a replenishing device located above the transporter; maintaining the replenishing device in a state that is ready to transfer the rod-like element to the transporter, wherein the rod-like element maintains a rotary motion; upon detecting an absence of the rod-like element from the reservoir in the flute of the transporter, replenishing the empty flute with the rod-like element; and rejecting the multi-segment rods comprising segments of the rod-like element that was transferred to the empty flute.

A velocity of the rod-like element in the replenishing device may be synchronized with a velocity of the transporter.

Upon detecting the absence of the rod-like element from the reservoir in the flute of the transporter, the method may further comprise replenishing the empty flute with a replacement rod-like element of a type other than the type of the rod-like element from the reservoir.

The advantage of the invention is that the replenishing device may constitute a feeder for continuous placing of the rod-like elements into the flutes of a linear flute transporter, for example a belt transporter.

The device according to the invention provides readiness for replenishing the flute and for maintaining the rod ready without influence on the quality of the rod being in rotation together with the rotary replenishing element, which is not in contact with the rod-like elements being in the flutes of the transporter.

In case of the rotary replenishing element having two seats, it is possible to simultaneously fill a first socket and to transfer the element to the flute from the second seat in case of replenishing multiple consecutive flutes.

It is also possible to transfer the rod-like element owing to an insignificant change of velocity of one of gearwheels, which can be effected in a short time.

BRIEF DESCRIPTION OF FIGURES

The object of the invention is described in details with reference to preferable embodiments shown in the drawing, wherein.

DESCRIPTION OF THE FIGURES

Figure 1:
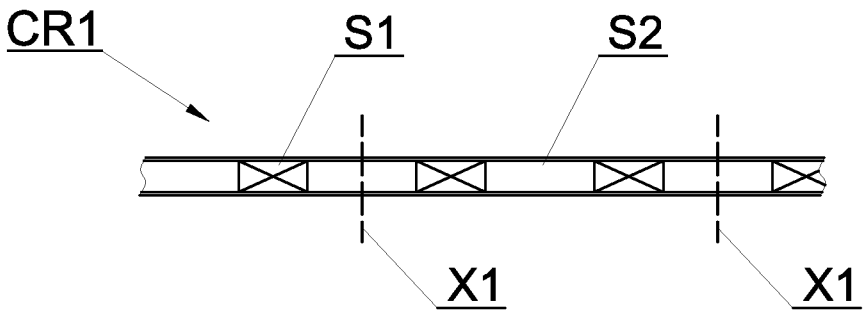
FIGS. 1 and 2 show fragments of exemplary continuous multi-segment rods.
Figure 2:
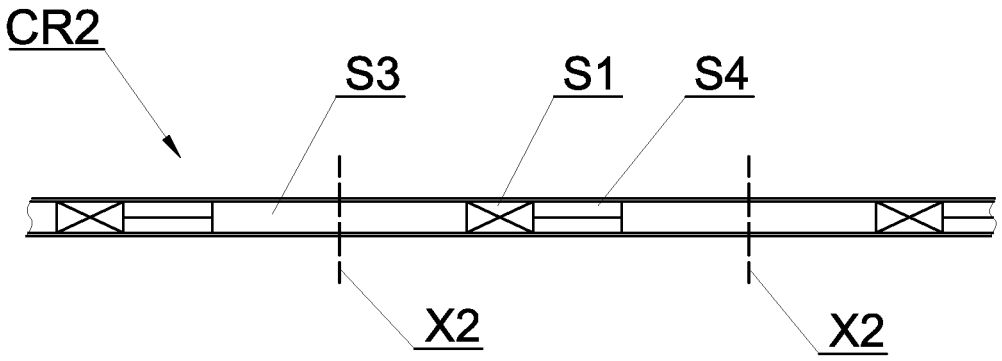

FIGS. 1 and 2 show fragments of examples of continuous multi-segment rods CR1 and CR2 formed from trains of segments S1, S2, S3 and S4 prepared during production, and formed as a result of operation of an apparatus for manufacturing multi-segment rods. The presented continuous multi-segment rods are cut into individual multi-segment rods. In FIGS. 1 and 2 exemplary cutting points of the rods CR1 and CR2 are presented by dashed lines X1 and X2. A distance between the consecutive lines, respectively X1 and X2, constitutes a length of the produced single multi-segment rods.

Figure 3:
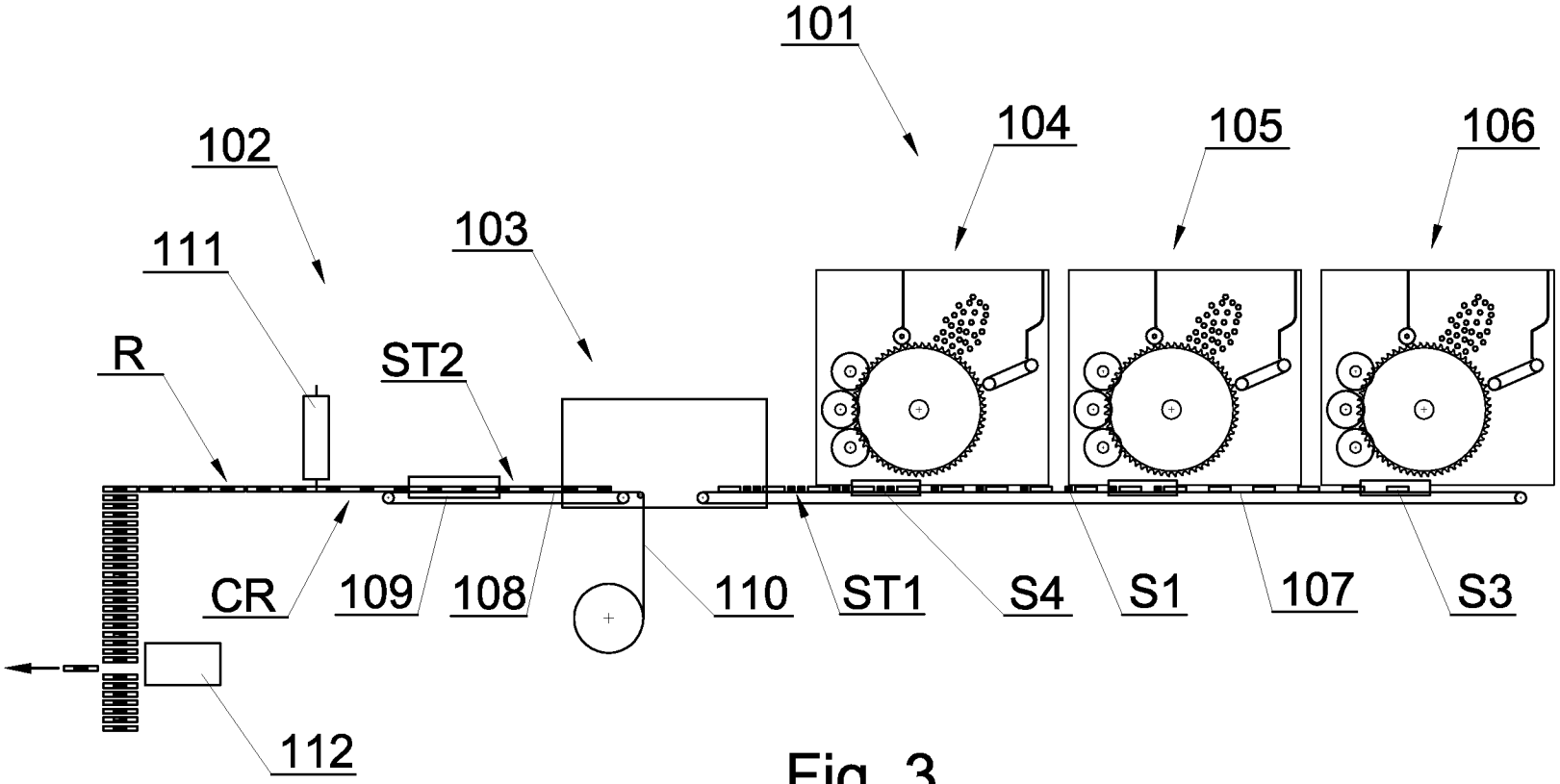
FIG. 3 shows a fragment of a machine for manufacturing multi-segment filter rods.

FIG. 3 shows a fragment of a machine for manufacturing multi-segment filter rods. The machine comprises a feeding unit 101, a garniture unit 102 and a transferring device 103 located between the feeding unit 101 and the garniture unit 102. The feeding unit 101 comprises feeding modules 104, 105 and 106, to which filter rods are delivered, and in which segments are produced such as S1, S3 and S4, which form the multi-segment rod CR2. The segments S1, S3 and S4 are placed on a feeder 107, which transfers them to the transferring device 103, wherein the train of the segments S1, S3, S4 which are arranged linearly and axially with respect to each other, is denoted as ST1. The transferring device 103 transfers the segments S1, S3, S4 received in the train ST1, from the feeding unit 101 to the garniture unit 102. Any transferring device, chosen from many devices known from the state of the art for transferring the segments (in general, rod-like elements) linearly and axially, may be utilized. In the garniture unit 102 the segments S1, S3, S4 are located on a garniture transporter 108 being a part of a garniture device 109, after a continuous wrapper 110 has been placed on the garniture transporter 108. A train ST2 of segments S1, S3, S4 is subsequently placed on the wrapper 110. The segments in the train ST2 may be distanced from the consecutive groups of segments or may be conveyed without gaps, such that the segments S1, S3, S4 maintain contact with each other. The train ST2 of the segments S1, S3, S4 moving on the garniture transporter 108 is wrapped by a wrapper 110 by means of the garniture device 109, wherein edges of the wrapper are joined with each other with glue. The formed continuous multi-segment rod CR is moved further and is cut into an individual multi-segment rods R by means of a cutting head 111. The feeding unit 101, which feeds the segments S1, S3, S4 linearly and axially one after another in the train ST1, may have any known form. In the presented embodiment each of the feeding modules 104, 105, 106 of the feeding unit 101 is equipped with a reservoir, to which the filter rods are supplied, the length of which being a multiple of the segments S1, S3, S4 length.

Figure 4:
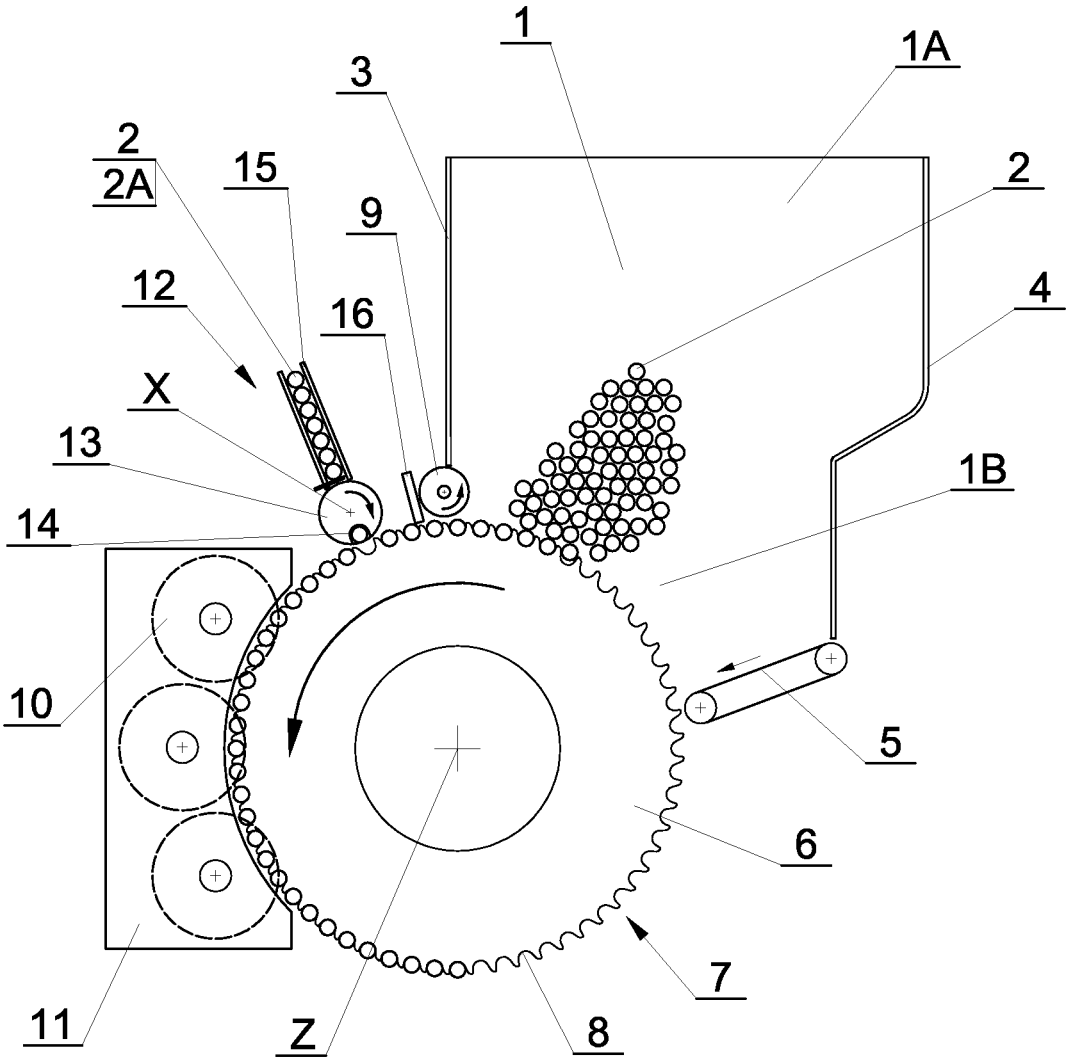
FIG. 4 shows an exemplary reservoir for rod-like elements and a first embodiment of a replenishing device.

An exemplary reservoir 1 for the rod-like elements 2 presented in FIG. 4 comprises an inlet part 1A and an outlet part 1B. The reservoir 1 is limited by sidewalls 3 and 4, wherein a conveyor 5, which directs the rod-like elements 2 towards the drum transporter 6 is located below the wall 4. A peripheral surface 7 of the drum transporter 6 and the conveyor 5 constitute a bottom wall of the reservoir 1. The peripheral surface is equipped with multiple flutes located in parallel with respect to an axis of rotation Z of the drum transporter 6, wherein the flutes 8 are adapted to receive rod-like elements 2 from the outlet part 1B (wherein for clarity of the drawing, only a portion of the rod-like elements 2 is shown). Under the sidewall 3, just above the peripheral surface 7 there is located a refuser roller 9, which sweeps off the rod-like elements 2, which due to the direction of rotation of the drum transporter 6 (in the drawing—counterclockwise) may become compressed and deformed in this region of the outlet part 1B. The sweeping roller 9 also rotates in a counterclockwise direction, thus it rotates in an opposite direction to the peripheral surface 7 of the drum transporter 6 pushing the rod-like elements 2 away and preventing their squeezing. The rod-like elements 2 are displaced in the flutes 8 and are cut into multiple single segments by means of disc knives 10 located on the cutting head 11. A replenishing device 12 is located between the sidewall 3 and the cutting head 11. The replenishing device 12 is equipped with a replenishing element 13 rotating about an X axis. The replenishing element 13 comprises a seat 14, in which a rod-like element 2 is placed, which will subsequently be placed in a flute 8 of the drum transporter 6 in case of detection of an empty (i.e. not filled) flute 8. The rod-like elements 2 are fed to the seat 14 from a feeding duct 15, wherein either rod-like elements 2 or replacement rod-like elements 2A having the same dimensions as the rod-like elements 2 but made of different material may be fed through the feeding duct 15. A sensor 16, which detects the presence of the rod-like element 2 inside the flute 8, is located between the replenishing device 12 and the side wall 3. The sensor may utilize the electromagnetic radiation, for example it may be an optical sensor or an infrared sensor. The sensor 16 may be located radially as presented in the drawing, or may also be located axially with respect to the flute 8 and the detected rod-like element 2.

Figure 5:
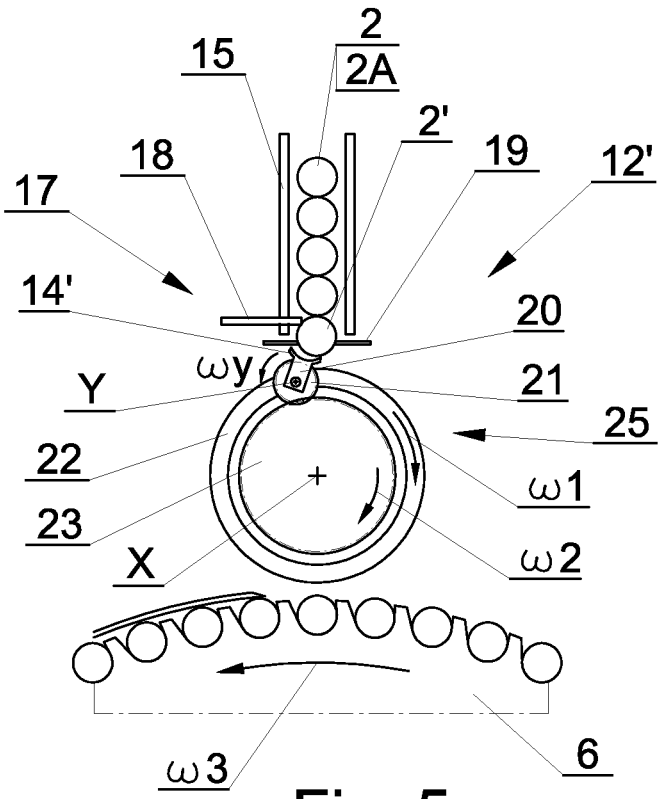
FIGS. 5-10 show a second embodiment of the replenishing device.

In a second embodiment presented in FIG. 5, a replenishing device 12' is equipped with a transferring seat 14' located on an arm 20, which is connected with a first gearwheel 21, which is mounted pivotally on an Y axis on a rotatable cantilever 22, which may have a form of a ring, a disc or a rotatable arm. The replenishing device 12' is also presented in a cross-section in FIG. 10. The cantilever 22 is mounted pivotally on an X axis and it rotates with a first rotational velocity ω1. The first gearwheel 21 is coupled with a second gearwheel 23, which is mounted pivotally on the X axis, wherein the second gearwheel 23 rotates with a second rotational velocity ω2, for simplicity of the drawing drives of the cantilever 22 and of the second gearwheel 23 are not shown. The arm 20, the first gearwheel 21, the cantilever 22, and the second gearwheel 23 constitute a rotary replenishing element 25. In FIG. 5 the seat 14' is located in a position just before receiving the rod-like element 2' from the feeding duct 15. At the outlet of the feeding duct 15 is located a dosing unit 17, which comprises a first blocking element 18 and a second blocking element 19. The first blocking element 18 is mounted slidably transversal with respect to the feeding duct 15 and allows separating a single rod-like element 2' and blocking remaining rod-like elements 2 in the feeding duct 15. A drive of the first blocking element 18 is not shown in the drawing, wherein the first blocking element 18 may be moved by means of a pneumatic cylinder or other linear drive. The second blocking element 19 allows holding of the separated single rod-like element 2', which will be transferred to the transferring seat 14'. The second blocking element 19 may be mounted slidably similarly as the first blocking element 18 or may have a form of a deformable blocking element such that it is possible to slide the rod-like element 2' out after deforming of the elements of the second blocking element 19.

Figure 6:
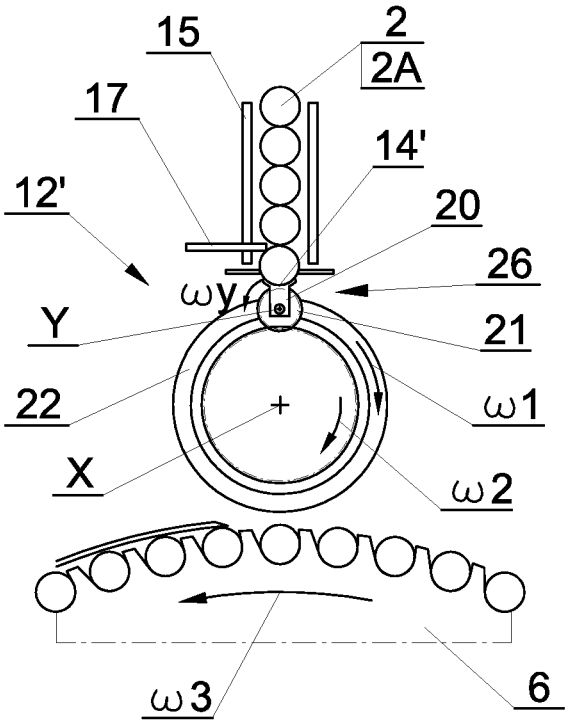
Figure 7:
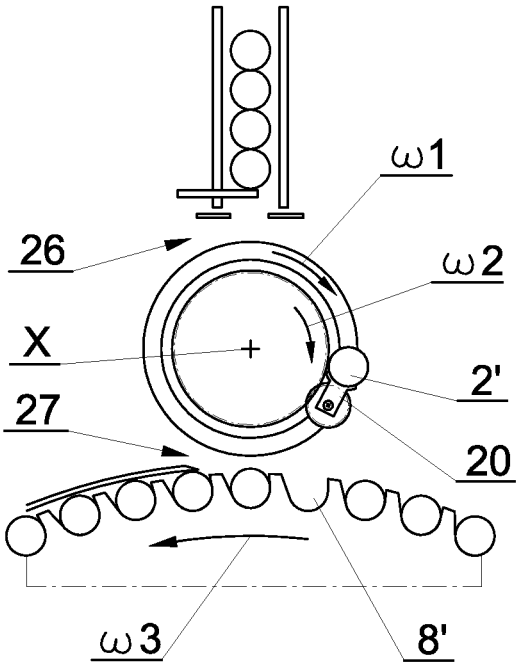

The cantilever 22 and the second gearwheel 23 are driven by separate drives, and a rotational velocity ωy of the first gearwheel 21 about the Y axis depends on a difference of the first rotational velocity ω1 of the cantilever 22, and the second rotational velocity ω2 of the second gearwheel 23. During receiving of the rod-like element 2' to the transferring seat 14', as depicted in FIGS. 5, 6 and 7, the rotational velocity ω2 is momentarily increased, owing to which the arm 20 together with the gearwheel 21 is rotated counterclockwise, with respect to the cantilever 22, with the velocity ωy about the Y axis, during the rotation of the Y axis about the X axis with the velocity ω1, in such a way that during transferring of the rod-like element 2', the arm 20 is positioned in a receiving zone 26 vertically as presented in FIG. 6, and the transferring seat 14' touches the rod-like element. At this moment the rod-like element 2' is received in the transferring seat 14', which holds the rod-like element 2' in a known manner by means of negative pressure supplied by openings located in the transferring seat 14' (not shown in the drawing). Higher velocity ω2 is maintained until the arm 20 reaches the position as shown in FIG. 7, then the velocities ω1 and ω2 are equalized. After equalizing the velocities ω1 and ω2, the velocity ωy will be equal to zero, the arm 20 will not change its position with respect to the cantilever 22, the rotary replenishing element 25 may rotate while being ready to transfer the rod-like element 2', which is kept in the seat 14', to the flute 8 of the drum transporter 6, i.e. to replenish the flute 8 with the rod-like element 2' in the transferring zone 27. The rod-like element which is in the seat 14', passes multiple times through the transferring zone 27, while not touching and not rubbing the rod-like elements 2 present in the flutes 8. The rod-like element 2' rotates about the X axis until the empty flute 8', which needs to be filled with the rod-like element 2', is detected. A position, presented in FIG. 6, of the rotary replenishing element 20 in front of the duct 15 at the time transferring the rod-like element 2' may be reached by means of momentary decrease of the velocity ω1 of the cantilever 22, after receiving of the rod-like element 2' in the seat 14', and analogously as before the rotational velocities col and ω2 are equalized, and then the velocity ωy is equal to zero, and the gearwheel 21 does not change its position with respect to the cantilever 22.

Figure 8:
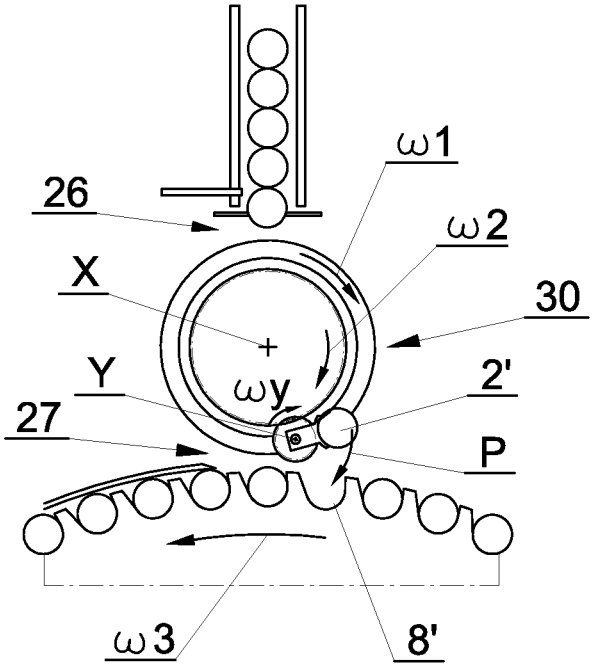
Figure 9:
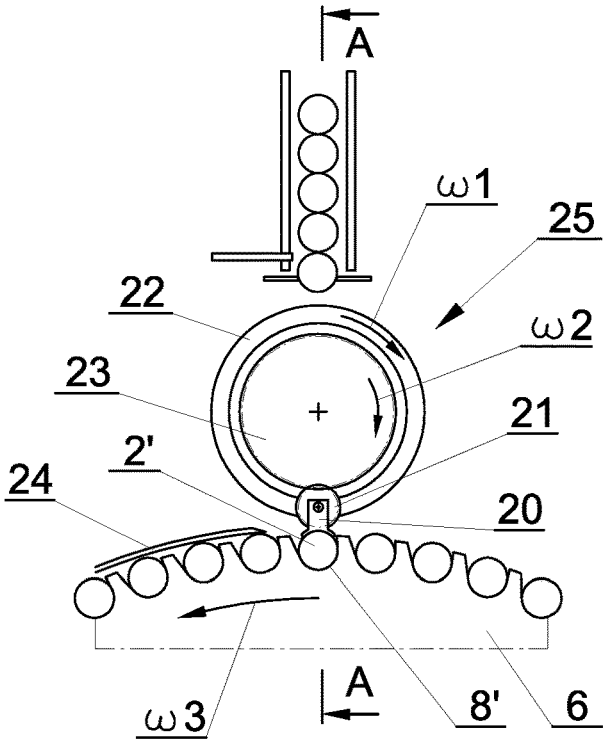
Figure 10:
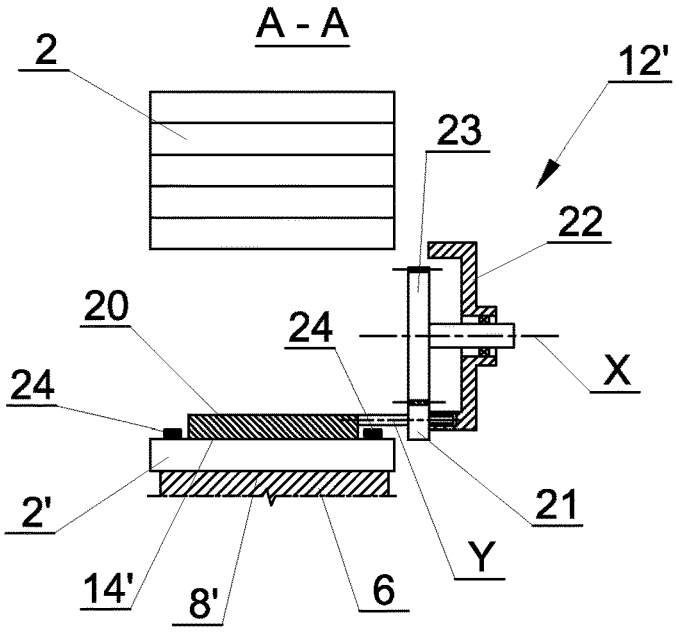

In case of detection of an absence of the rod-like element 2 in the flute 8', a displacement of the rod-like element 2' to the position allowing it to be placed in the flute 8' is started, wherein the displacement is effected during the rotational movement of the replenishing element 25 and is based on the rotation of the arm 20 and the rod-like element 2' in a direction depicted by an arrow P (FIG. 8) in the transferring zone. For this purpose the rotational velocity ω2 is decreased or the rotational velocity ω1 is increased, wherein the velocity ω1 must be adapted to the velocity ω3 of the drum transporter 6 such that linear velocity of the rod-like element 2' is equalized with the linear velocity of the flute 8' at the time of transferring of the rod-like element 2'. At the time of transferring of the rod-like element 2' to the flute 8', the arm 20 together with the transferring seat 14' has the velocity ωy having an opposite direction (FIG. 8) than at the time of receiving of the rod-like element 2' from the feeding duct 15 (FIG. 5, FIG. 6). FIG. 9 shows a moment of placing of the rod-like element 2' in the flute 8'. The negative pressure, which held the rod-like element 2' inside the transferring seat 14' is turned off, and through the same openings compressed air may be supplied to push the rod-like element 2' out, wherein the rod-like element 2' is held by the negative pressure supplied through the openings in the flute 8' (not shown in the drawing). In a further stage of the movement, the velocities ω1 and ω2 are maintained equal to each other. The rod-like element 2' had a previously imparted rotational velocity and the synchronization of the velocities of the rotary replenishing element 25 and the velocity of displacement of the flutes 8 and a relative position of the transferring seat 14' and the flute 8' during the transferring of the rod-like element 2, 2A allows an effective transferring of the rod-like element 2' to the flute 8'. Imparting the velocity before the transfer and synchronization of the velocity provides a decrease of mechanical loads, which act on the rod-like element, which is transferred to the flute 8. Above the peripheral surface 7 of the drum transporter 6 are located guides 24 which hold the rod-like elements 2 inside the flutes 8 and prevent accidental falling out of the rod-like element 2' from the flute 8' during displacement of the transferring seat 14' away. The transferring seat 14', the first gearwheel 21 and the second gearwheel 23 together with the arm 20 and the cantilever 22 and optionally not shown elements for supplying the compressed air constitute a transferring mechanism 30. FIG. 10 shows a cross-section A-A of the replenishing device 12' in a position as shown in FIG. 9.

Replacement rod-like elements 2A having the same dimensions as the rod-like element 2 may be placed in the feeding duct 15. The replacement rod-like element 2A is made of a different material from that of the rod-like element 2 and may have a greater resistance against loads which occur during replenishing of the flute 8'. The segments formed after cutting the replacement rod-like element 2A will be placed in several multi-segment rods R, wherein such multi-segment rods are considered as defective rods and are rejected by an ejector 112 presented in FIG. 3.

Figure 11:
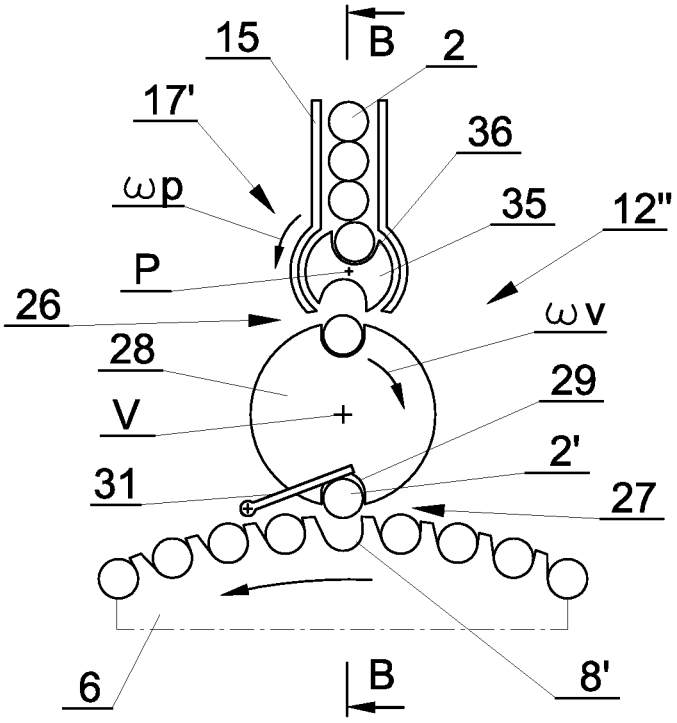
FIGS. 11-12 show a third embodiment of the replenishing device.
Figure 12:
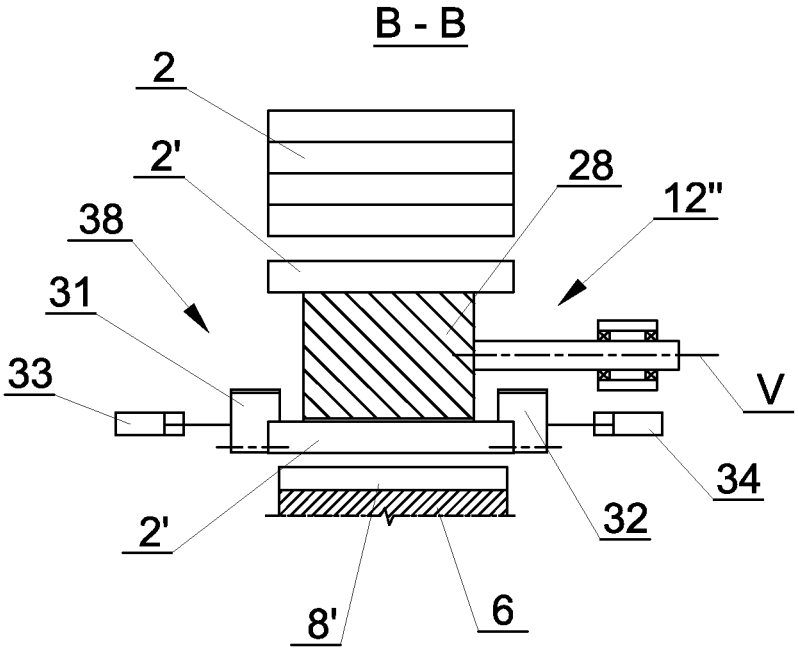

FIG. 11 shows a third embodiment of a replenishing device 12" equipped with a rotary replenishing element 28 comprising two transferring seats 29. The rotary replenishing element 28 may have one transferring seat. The rod-like elements 2 are received in the transferring seat 29 in a receiving zone 26 and are transferred to the flutes 8 in the transferring zone 27. The rod-like elements 2' are held in the transferring seats 29 by means of negative pressure. The rotary replenishing element 28 rotates in a continuous manner with a rotational velocity ωv, being ready to replenish the flute 8, wherein the rod-like elements 2' present in the transferring seats 29 are passing through the transferring zone 27 multiple times, whereas the velocities of the transferring seats 29 and of the flutes 8 and their relative positions are synchronized with each other. In a case of detection of an absence of the rod-like element in the flute 8', the rod-like element 2' is transferred to this seat, by means of starting the transferring mechanism 38 comprising two pushing-off elements 31, 32 which are displaced by means of actuators 33, 34 (cross-section B-B in FIG. 12) or by means of other driving elements, such that the transferring of the rod-like element 2' into the flute 8' is effected. The pushing elements 31, 32 have a form of flat plates and are displaced for example by means of the cylinders 33, 34, wherein the pushing elements may have any other form. Moreover simultaneously with the displacement of the pushing elements 31, 32, the negative pressure is deactivated and optionally the compressed air is supplied, which makes it easier to push out and to transfer the rod-like element 2' to the flute 8'.

In the abovementioned embodiment the replenishing device 12" comprises a dosing unit 17' located at the outlet of the duct 15, equipped with a rotary dosing element 35 comprising seats 36, wherein the rotary dosing element 35 rotates with the velocity ωp about an axis P in time when it is necessary to feed the rod-like element 2 to the seat 29.

Figure 13:
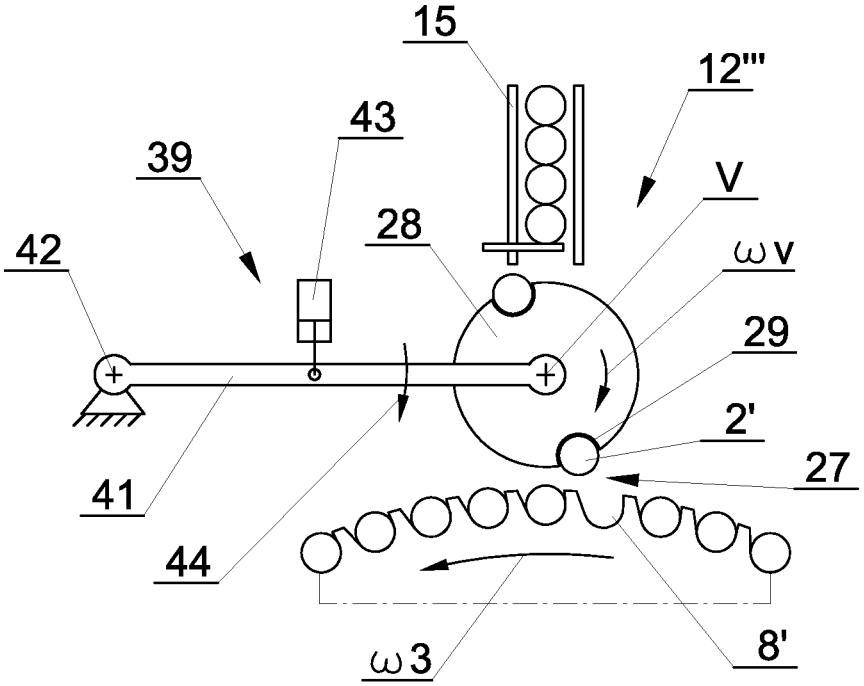
FIG. 13 shows a fourth embodiment of the replenishing device.

FIG. 13 shows a fourth embodiment of a replenishing device 12"' equipped with a rotary replenishing element 28 comprising two transferring seats 29 as in previous embodiment, wherein the replenishing element 28 is mounted pivotally on a lever 42 having a stationary axis of rotation 41. The lever 42 is adapted to change its position, wherein in the presented embodiment, change of the position is effected by a cylinder 43. The replenishing element 28 rotates with the velocity ωv which is adapted to the velocity ω3 of the drum transporter 6, wherein the rod-like element 2' which is held in the seat 29 is passing through the transferring zone 27 multiple times, while maintaining synchronization of the velocity and the position. When the empty (not filled) flute 8' is detected, then the cylinder 43 is activated, which causes a displacement of a rotary replenishing element 28 to its bottom position according to the direction of an arrow 44. During lowering of the rotary replenishing element 28, the negative pressure, holding the rod-like element 2' in the seat 29, is deactivated. After placing the rod-like element inside the flute 8', the lever 41 and the rotary replenishing element return to their home positions as presented in FIG. 13. At the outlet of the supply duct 15 there may be any dosing unit employed.

Figure 14:
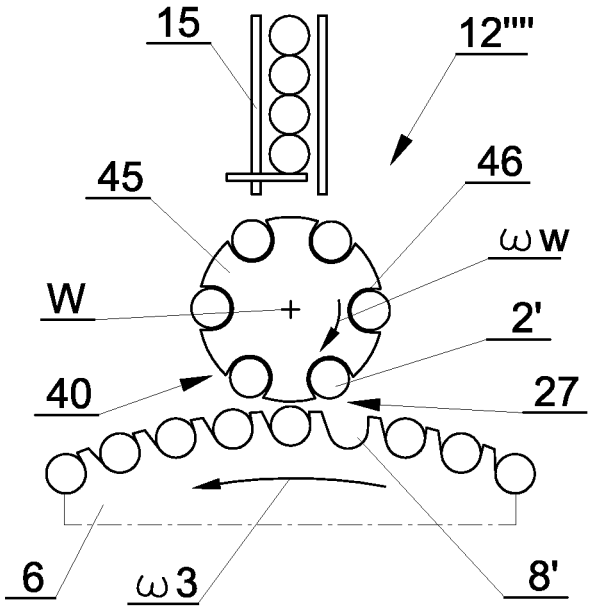
FIG. 14 shows a fifth embodiment of the replenishing device.
Figure 15:
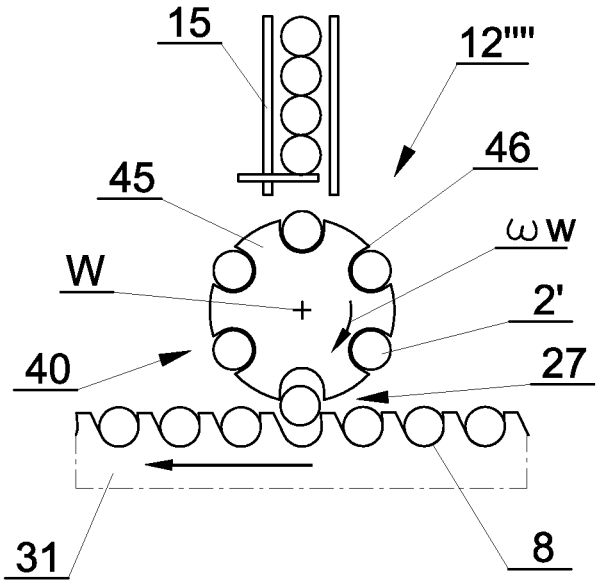
FIG. 15 shows the replenishing device of FIG. 14 cooperating with a belt transporter.

A replenishing device 12"" in a fifth embodiment presented in FIG. 14 is equipped with a rotary transferring element 45 comprising six seats 46. The rod-like elements 2' are held in the seats 46 by means of negative pressure and are the transferring of the rod-like element 2' is effected by deactivating the negative pressure in the seat 46 in an appropriate moment and supplying the compressed air. A transferring mechanism 40 comprises a negative pressure supply unit and a compressed air supply unit. FIG. 15 shows the abovementioned replenishing device 12"" cooperating with a belt transporter 31 having flutes 8 analogously as the drum transporter 6.

The invention claimed is:

1. A replenishing device for replenishing a flute of a transporter with a rod-like element, comprising:

a transporter comprising multiple flutes located transversally with respect to a transporting direction and adapted to transport rod-like elements;

a feeding duct for feeding the rod-like element;

a rotary replenishing element having an axis of rotation, comprising at least one transferring seat for receiving the rod-like element from the feeding duct in a receiving zone and for transferring the rod-like element to the flute of the transporter in a transferring zone, wherein the rotary replenishing element is adapted to repeatedly pass the same rod-like element through the transferring zone before transferring that rod-like element to the flute of the transporter upon detection of an empty flute by a rod-like element electronic sensor; and a transferring mechanism for effecting the transfer of the rod-like element from the transferring seat to the flute of the transporter and adapted to transfer the rod-like element towards the flute of the transporter with a force supplemental to gravitational force and centrifugal force resulting from rotation of the rotary replenishing element.

2. The device of claim 1, wherein the rotary replenishing element comprises at least two seats.

3. The device of claim 1, wherein the transferring mechanism comprises movable pushing-off elements.

4. The device of claim 2, wherein the transferring mechanism comprises movable pushing-off elements.

5. The device of claim 1, wherein the transferring mechanism comprises a pivotal lever on which an axis of rotation (V) of the rotary replenishing element is mounted.

6. The device of claim 2, wherein the transferring mechanism comprises a pivotal lever on which an axis of rotation (V) of the rotary replenishing element is mounted.

7. The device of claim 1, wherein the transferring mechanism comprises a negative pressure supply unit for holding the rod-like element in the transferring seat and a compressed air supply unit for pushing the rod-like element from the transferring seat into an empty flute.

8. The device of claim 1, wherein the transferring seat has an axis of rotation (Y) that circulates around the axis of rotation (X) of the rotary replenishing element.

9. The device of claim 8, wherein the seat of rotary replenishing element is connected to a first gear wheel with the axis (Y) rotating with a first rotational velocity ($\omega$1), a second gear wheel coupled to the first gear wheel rotating with a second rotational velocity ($\omega$2), and a rotational velocity ($\omega$y) of the seat depends on a difference between the first rotational velocity ($\omega$1) and the second rotational velocity ($\omega$2).

10. The device claim 8, wherein the transferring seat is mounted on an arm and connected to a first gear wheel coupled with a second gear wheel.

11. The device of claim 9, wherein the transferring seat is mounted on an arm and connected to the first gear wheel coupled with the second gear wheel.

12. The device of claim 1, wherein a velocity imparted to the rod-like element by the transferring seat in the transferring zone is equal to a velocity of the flute.

13. The device of claim 1, wherein a velocity imparted to the rod-like element by the transferring seat in the transferring zone is equal to a velocity of the flute.

14. An apparatus for manufacturing multi-segment rods, the apparatus comprising:

a feeding unit comprising feeding modules, each module having a replenishing device comprising a transporter comprising multiple flutes located transversally with respect to a transporting direction and adapted to transport rod-like elements;

a feeding duct for feeding the rod-like element;

a rotary replenishing element having an axis of rotation, comprising at least one transferring seat for receiving the rod-like element from the feeding duct in a receiving zone and for transferring the rod-like element to the flute of the transporter in a transferring zone, wherein the rotary replenishing element is adapted to repeatedly pass the same rod-like element through the transferring zone before transferring that rod-like element to the flute of the transporter upon detection of an empty flute by a rod-like element electronic sensor; and a transferring mechanism for effecting the transfer of the rod-like element from the transferring seat to the flute of the transporter;

a garniture unit comprising a garniture device and a cutting head;

a transferring device located between the feeding unit and the garniture unit adapted to transfer the rod-like element towards the flute of the transporter with a force supplemental to gravitational force and centrifugal force resulting from rotation of the rotatory rotary replenishing element.

15. The device of claim 14, wherein the rotary replenishing element comprises at least two seats.

16. The device of claim 14, wherein the transferring mechanism comprises movable pushing-off elements.

17. A method for manufacturing multi-segment rods, the method comprising the steps of:

supplying at least two types of rod-like elements to separate feeding modules of a manufacturing machine;

placing the rod-like elements in a reservoir of the feeding module of the manufacturing machine;

placing the rod-like elements, accumulated in the reservoir, into flutes of a transporter in a transporting path of the feeding module;

cutting the rod-like elements into segments while the rod-like elements are transported on the transporter;

forming a train of segments comprising a plurality of segments supplied by the transporting paths from individual reservoirs of the feeding modules;

wrapping the formed train of plurality of segments by a wrapper to form a continuous rod;

cutting the formed continuous rod into individual multi-segment rods, delivering a rod-like element to a rotary replenishing element of a replenishing device located above the transporter;

maintaining the replenishing device in a state that is ready to transfer the rod-like element to the transporter, wherein the rod-like element maintains a rotary motion;

upon detection of an empty flute by a rod-like element electronic sensor, replenishing the empty flute with the rod-like element from the reservoir in the flute of the transporter; and rejecting the multi-segment rods comprising segments of the rod-like element that was transferred to the empty flute.

18. The method of claim 17, wherein a velocity of the rod-like element in the replenishing device is synchronized with a velocity of the transporter.

19. The method of claim 17, wherein, upon detecting the absence of the rod-like element from the reservoir in the flute of the transporter, the method further comprises replenishing the empty flute with a replacement rod-like element of a type other than the type of the rod-like element from the reservoir.

20. The method of claim 18 wherein, upon detecting the absence of the rod-like element from the reservoir in the flute of the transporter, the method further comprises replenishing the empty flute with a replacement rod-like element of a type other than the type of the rod-like element from the reservoir.

* * * * *